United States Patent [19]

Karashima

[11] 4,148,197

[45] Apr. 10, 1979

[54] DEFROSTER ARRANGEMENT IN A REFRIGERATING SHOWCASE

[76] Inventor: Masashi Karashima, 2-40-7,Sangenjaya, Setagaya-ku, Tokyo, Japan

[21] Appl. No.: 800,554

[22] Filed: May 25, 1977

[30] Foreign Application Priority Data

Apr. 25, 1977 [JP] Japan ..... 52/46803

[51] Int. Cl.[2] ..... A47F 3/04

[52] U.S. Cl. ..... 62/256; 62/282

[58] Field of Search ..... 62/256, 255, 80, 82, 62/282; 98/36

[56] References Cited

U.S. PATENT DOCUMENTS

| | | | |
|---|---|---|---|
| 2,960,844 | 11/1960 | Quick | 62/256 X |
| 3,094,851 | 6/1963 | Beckwith | 62/256 |
| 3,226,945 | 1/1966 | Spencer | 62/256 |
| 3,403,525 | 10/1968 | Beckwith et al. | 62/255 X |
| 3,722,892 | 3/1964 | Beckwith | 62/256 X |

*Primary Examiner*—William E. Wayner
*Assistant Examiner*—William E. Tapolcai, Jr.
*Attorney, Agent, or Firm*—Wenderoth, Lind & Ponack

[57] ABSTRACT

An improved defroster arrangement for a known refrigerating showcase which is provided with an inside duct for circulating a refrigerated air flow to refrigerate the interior of the showcase and an outside duct for circulating a low temperature air flow to prevent a temperature rise of the refrigerated air flow. The improvements exist in the provision of a communication passage between the inside and outside ducts, and a gate for opening and closing the communication passage. During defrosting, the gate is actuated to communicate the inside and outside ducts with each other through the communication passage and also to block the path through the outside duct between the communication passage and an intake port. In this manner only the air circulating through the inside duct upstream of the gate and through both the inside and outside ducts downstream of the gate is driven by means of fans disposed within the inside and outside ducts, respectively. Also ambient air may be jointly sucked into the inside duct upstream of the gate means.

2 Claims, 4 Drawing Figures

DEFROSTER ARRANGEMENT IN A REFRIGERATING SHOWCASE

BACKGROUND OF THE INVENTION

The present invention relates to improvements in defroster arrangements in refrigerating show cases for display and sale of fresh and/or refrigerated goods which are used in super markets or the like.

In such a refrigerating showcases, normally inside and outside ducts are provided in juxtaposition, and air refrigerated by a refrigerator contained in the inside duct is blown out from an upper blow-out port across a front surface of the showcase and is sucked into a suction port on the same front surface to form an air curtain along the front surface of the showcase. In addition, by means of low temperature air flowing through the outside duct another air curtain outside of the first said air curtain is formed to protect the case from invasion of an ambient air, whereby a temperature rise in the interior of the showcase is prevented.

When the defrosting operation is carried out in the above-described type of refrigerating showcases, the supply of refrigerant to the refrigerator is interrupted which stops the refrigerating operation of the refrigerator, and subsequently, a heater mounted in the front of the refrigerator is actuated. Then, as the temperature of the heater rises, the temperature of the cool air passing through the refrigerator also rises gradually, resulting in a rise in the temperature inside of the showcase.

This defrosting process, consisting of raising the temperature of the cool air circulating through the inside duct at a limited flow rate and making the cool air flow pass through a disabled refrigerator as described above, takes an extended time to complete the defrosting and so, there is a danger that it may adversely affect the fresh and/or refrigerated goods in the showcase.

SUMMARY OF THE INVENTION

The present invention has been proposed in view of the above-mentioned status of the prior art, and one object of the present invention is to provide an improved defroster arrangement in a refrigerated showcase which can achieve defrosting of a refrigerator in a short period of time at a maximum efficiency and which can maintain the temperature in the showcase as low as possible.

In order to achieve the aforementioned object, according to one feature of the present invention, a refrigerating showcase provided with an inside duct for circulating a refrigerated air flow to refrigerate the interior of said showcase and an outside duct for circulating a low temperature air flow to prevent a temperature rise of the refrigerated air flow in juxtaposition, comprises communication means between the inside and outside ducts and gate means for opening and closing the communication means. Upon defrosting, the communication means is opened by the gate means which communicates the inside and outside ducts with each other through the communication means and also the path through the outside duct between the communication means and an intake port is blocked by the gate means, whereby not only the refrigerated air for refrigerating the interior of the showcase but also an ambient air may be jointly sucked into the inside duct by means of fans disposed within the inside and outside ducts, respectively.

Brief Description of the Drawings

The mentioned and other features and objects of this invention will become more apparent by reference to the following description taken in conjunction with the accompanying drawings, in which.

DETAILED DESCRIPTION OF THE INVENTION

Figure 1:
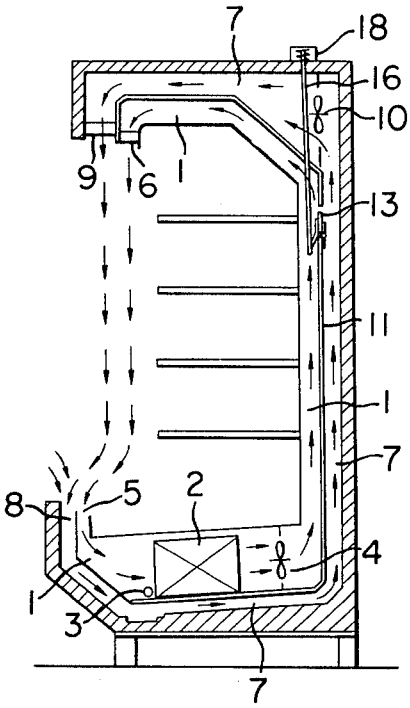
FIGS. 1 and 2 are longitudinal cross-section side views of a refrigerating showcase incorporating a defroster arrangement according to the present invention showing the state of normal operation and the state of defrosting, respectively.
Figure 2:
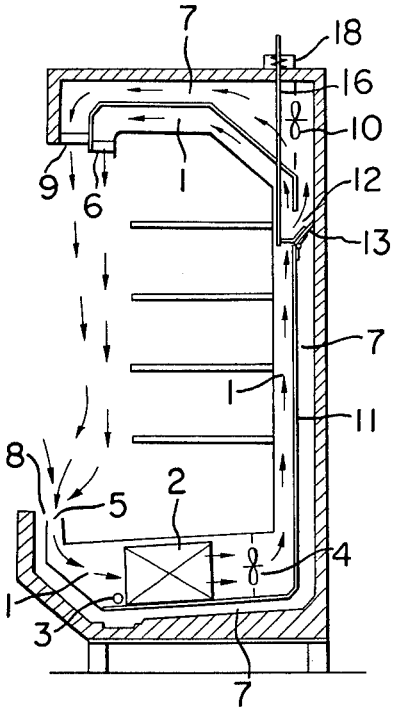

Now the present invention will be described in more detail in connection to the preferred embodiment illustrated in the drawings.

Reference numeral (1) designates an inside duct in a refrigerating showcase for circulating a refrigerated air flow to refrigerate the interior of the showcase, in which are contained a refrigerator (2), at a position on the bottom wall of the showcase, a defrosting heater (3), and a fan (4) at the positions before and behind the refrigerator (2). The foremost end of the inside duct 1 is connected to an intake port (5) at the bottom of a front surface opening of the showcase. In addition, the rear of duct (1) extends along the inside of the rear wall and the top wall of the showcase and communicates with a blow-out port (6) at the top of the front surface opening of the showcase.

Outside of the inside duct (1) is an outside duct (7) for circulating a low temperature air flow to prevent a temperature rise in the refrigerated air for refrigerating the interior of the showcase, in juxtaposition to the inside duct (1). The foremost end of the duct (7) is connected to an intake port (8) at the bottom of the front surface opening of the showcase; the rear end of the duct (7) extends along the inside of the rear wall and the top wall of the showcase and communicates with a blow-out port (9) at the top of the front surface opening of the showcase; and within the duct (7) along the top wall is a fan (10).

At an upper position on the inside of the rear wall of the showcase, a communication aperture (12) is provided in a partition wall 11 for communicating the inside and outside ducts (1) and (7) with each other. At the communication aperture (12) is a gate device which is fully described later.

Figure 3:
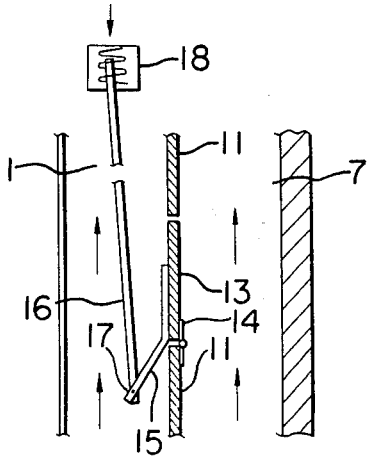
FIGS. 3 and 4 are enlarged longitudinal cross-section side view of a communication section between the inner and outer ducts in the defrosting arrangement in FIGS. 1 and 2, showing the state of normal operation and the state of defrosting, respectively.
Figure 4:
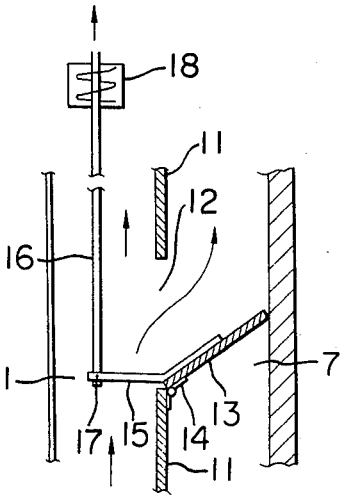

FIGS. 3 and 4, respectively, show the gate device at the communication aperture (12). A lower end of a door piece (13) for opening and closing the communication aperture (12) is hinged at (14) to the partition wall (11). A lower end of an actuating rod (16) movable vertically within the showcase is pivotably coupled at (17) to an arm (15) disposed on the door piece (13) and projects therefrom. Normally the actuating rod (16) is lowered by its own gravity or by biasing means not shown so that the communication aperture (12) is blocked by the door piece (13) as shown in FIG. 3. However, by energizing a solenoid (18) equipped on the top wall of the showcase to raise the actuating rod (16), the door piece (13) is made to rotate in the clockwise direction until its free end abuts against the inner rear wall surface and opens the communication aperture (12), thereby communicating the inside and outside ducts (1) and (7) through the communication aperture (12). Also, the section of the outside duct (7) between the communication aperture (12) and the intake port (8) is blocked as shown in FIG. 4. It is to be noted that the door piece (13) could be actuated for opening and closing by any other appropriate means.

Upon defrosting the above-described refrigerating showcase, the supply of refrigerant to the refrigerator (2) is interrupted to stop its refrigerating operation, and the heater (3) is actuated. The actuating rod (16) is pulled up by means of the solenoid (18) to open the communication aperture (12) and also block the section of the outside duct (7) between the communication aperture (12) and the intake port (8) with the door piece (13) as shown in FIG. 4.

At this time, not only the refrigerated air flow blown out of the blow-out port (6) of the inside duct (1), but also the low temperature air flow blown out of the blow-out port (9) of the outside duct (7) are jointly sucked into the inside duct (1) through the intake port (5) by the action of the fans (4) and (10) within the inside and outside ducts (1) and (7), respectively. Thus an air flow having an increased flow rate passes through the disabled refrigerator (2) and the inside duct (1), branches into the inside and outside ducts (1) and (7) at the communication aperture (12) and is blown from the blow-out ports (6) and (9), respectively. Thus, the air flow circulates around the interior of the showcase while preventing a temperature rise of the goods in the showcase by establishing an air curtain across the front surface opening of the showcase.

Now, since an air flow having a larger flow rate than normal operation is being sucked into the single intake port (5) the, distribution of lines of flow in the proximity of the intake port (5) are largely varied, so that the ambient air shielding capability of the air curtain is reduced due to an aerodynamic effect. Accordingly, atmospheric air at a relatively high temperature enters the intake port (5), and as a result, at the refrigerator (2) the temperature is quickly raised by the mixing of the hot atmospheric air, and furthermore, since the air passes at an increased flow rate, the defrosting time for the refrigerator (2) is greatly shortened and thus the temperature of the goods within the showcase can be maintained as low as possible.

When the defrosting operation has been finished, the solenoid (18) is denergized and the actuating rod (16) lowers, and door piece (13) restored to its original position to block the communication aperture (12). Thereafter, normal operation of the refrigerating showcase is commenced.

As described above, according to the present invention, during defrosting of the refrigerating showcase, the communication aperture between the inside and outside ducts is opened by the gate device to communicate the inside and outside ducts with each other through the communication aperture, and a section of the outside duct between the communication aperture and the intake port is blocked. Air is sucked through the intake port of the inside duct and blown out through the blow-out ports of both the inside and outside ducts by means of fans in the inside and outside ducts, respectively. Both the refrigerated air flow for refrigerating the interior of the showcase and the low temperature air flow for preventing a temperature rise of the refrigerated airflow are sucked, and at the same time, ambient air at a relatively high temperature is sucked into the inside duct. Thus, by passing an air flow having an increased flow rate and having its temperature raised by mixing with ambient air through the refrigerator contained in the inside duct, the defrosting time can be shortened. Further, in addition to the function that during the defrosting operation the interior of the showcase is protected from invasion of the ambient air by means of the air curtain established across the front surface opening of the refrigerating showcase, this shortened defrosting time can suppress the temperature rise of the goods displayed in the showcase to as low as possible, and thereby can prevent an adverse effect upon the goods.

While the invention has been described above in its preferred embodiment, it is a matter of course that the invention should not be limited only to such preferred embodiment, since various changes in design can be made without departing from the spirit of the present invention.

What is claimed is:

1. A refrigerating apparatus comprising:

an open front showcase;

inside duct means around the inside of said showcase for circulating a first flow of air across said open front, said inside duct means having a first inlet at the bottom of said open front, a first outlet at the top of said open front, and a first duct connecting said first inlet and outlet;

a refrigerating device between said first inlet and said first outlet within said first duct;

a defrosting heater within said first duct;

a first fan within said first duct;

outside duct means around the inside of said showcase adjacent said inside duct means for circulating a second flow of air across said open front next to said first air flow between said first air flow and the ambient, surrounding air, said outside duct means having a second inlet adjacent said first inlet, a second outlet adjacent said first outlet, and a second duct connecting said second outlet and second inlet;

a second fan in said second duct;

communication means between said first and second duct between the location of said first fan and said second fan for permitting the air flowing through said first duct to enter into said second duct; and gate means fitted over said communication means for opening and closing said communication means between said first and second duct and for closing said second duct between said second inlet and said second fan when said communication means is open.

2. In a refrigerating showcase which has an inside duct for circulating a refrigerated air flow to refrigerate the interior of said showcase and an outside duct for circulating a low temperature air flow adjacent said refrigerated air flow, an improvement comprising:

communication means between said inside and outside ducts; and gate means for opening and closing said communication means and for blocking the upstream flow of air through said outside duct when said communication means is open.

* * * * *